US007335083B2

(12) United States Patent
Hwang

(10) Patent No.: US 7,335,083 B2
(45) Date of Patent: Feb. 26, 2008

(54) SHEET TYPE BALLOON

(76) Inventor: Hye Sung Hwang, 108-402 Mijudongbangbyukwoon Apt. 1265, Nowon-Gu, Seoul (KR)

( * ) Notice: Subject to any disclaimer, the term of this patent is extended or adjusted under 35 U.S.C. 154(b) by 327 days.

(21) Appl. No.: 10/767,048

(22) Filed: Jan. 29, 2004

(65) Prior Publication Data

US 2005/0153622 A1 Jul. 14, 2005

(30) Foreign Application Priority Data

Jan. 12, 2004 (KR) ..... 20-2004-0000695 U

(51) Int. Cl.
*A63H 27/10* (2006.01)

(52) U.S. Cl. ..... 446/220

(58) Field of Classification Search ..... 446/220, 446/224, 226; 383/61.2, 63, 64
See application file for complete search history.

(56) References Cited

U.S. PATENT DOCUMENTS 3,098,317 A * 7/1963 Guzman ..... 446/226
3,672,083 A * 6/1972 Moran ..... 40/540
4,848,773 A * 7/1989 Lovik ..... 473/505
5,108,339 A 4/1992 Kieves
5,295,892 A * 3/1994 Felton ..... 446/224
5,383,806 A * 1/1995 Prater ..... 446/220
5,460,200 A * 10/1995 Glicksman ..... 137/512.4
5,482,492 A 1/1996 Becker
5,860,441 A * 1/1999 Garcia ..... 137/15.18
5,951,359 A * 9/1999 Prakopcyk et al. ..... 446/220
6,004,032 A * 12/1999 Kapperman et al. ..... 383/5
6,435,935 B1 * 8/2002 Komaba ..... 446/220
6,663,455 B1 * 12/2003 Lang ..... 446/71
6,699,095 B1 * 3/2004 Epstein ..... 446/222
6,874,421 B2 * 4/2005 Kitchin et al. ..... 101/492
2003/0035909 A1 * 2/2003 Liau ..... 428/35.4

* cited by examiner

*Primary Examiner*—John A. Ricci
(74) *Attorney, Agent, or Firm*—Jordan and Hamburg LLP

(57) ABSTRACT

A sheet type balloon has a blank, colorable area partly formed on an outer surface of a body, so the balloon is available for coloring or studying materials as well as typical playing materials. The balloon further has a valve assembly having bi-directional functions, i.e., deflation and inflation of the balloon. To inflate the balloon with air or gas, a fastener of the valve assembly is open by separating a convexly protruding line and a concavely protruding line. After inflation, the fastener is closed by apply a pressure to both protruding lines, so the protruding lines are closely combined and thus intercept the outward flow of inflating air or gas within the body. Then, for carrying or reuse, the fastener can be open again by separating the protruding lines.

7 Claims, 7 Drawing Sheets

SHEET TYPE BALLOON

BACKGROUND OF THE INVENTION

1. Field of the Invention

The present invention relates generally to a balloon and, more particularly, to a sheet type balloon used as studying or playing materials.

2. Description of the Related Art

Conventional balloons are made chiefly of rubber or synthetic resin in the form of variously shaped, hollow bags inflated with air or gas, and generally used as playing materials, i.e., toys. However, conventional balloons are difficult to use for purposes related to coloring or studying because the surface of the balloon is not easily colored with crayons or paints after fabrication. The surface of the balloon is merely colored or printed during fabrication.

U.S. Pat. No. 5,108,339 has introduced a non-latex balloon, which includes a first inner balloon encompassed by a partially transparent second outer balloon. It is true that this balloon is a colorfully designed, interesting product, but such a toy balloon does not seem suited for coloring or studying materials.

Also, U.S. Pat. Nos. 5,108,339 and 5,482,492 have disclosed valves introducing an inflating gas into the balloon interior. However, these valves need additionally an inflation probe, such as a straw-like slender tube, so as to supply the filling fluid such as air into the valves. Therefore, such a valve and balloon assembly may cause inconvenience to a user, and furthermore, a user may be often hurt when he blows air carelessly into the inflation pipe with the inflation probe in his mouth. Moreover, since the above-discussed valves have structural limitations that a backward flow of an inflating gas is not allowed, the above balloons are not handy to carry with an inflating gas deflated. Unfortunately, this invites reuse issues and environmental pollution.

SUMMARY OF THE INVENTION

It is, therefore, an object of the present invention to provide an improved sheet type balloon that can be utilized as coloring or studying materials as well as playing materials.

Another object of the present invention is to provide an improved sheet type balloon that allows an easy deflation of air or gas, thus promoting the convenience in use, carrying, and reuse.

According to one embodiment of the present invention, a sheet type balloon is provided, which comprises a body, a valve assembly, and a blank, colorable area. The body has an internal space defined by a joined periphery, and after inflated, has a particular shape. The valve assembly is formed at a specific place of the joined periphery so as to allow an inflation gas to be introduced into the internal space. The blank, colorable area is partly formed on an outer surface of the body and is available for coloring with crayons or paints.

According to alternative embodiments of the present invention, the sheet type balloon may further comprise a printed area formed around the colorable area. Further, the body may include a pair of sheets joined together at the joined periphery. Each sheet may have a paper layer allowing to be colored, a nylon layer improving durability of the sheet, a first outer polyethylene layer intervening between and firmly connecting the paper layer and the nylon layer, and a second inner polyethylene layer facilitating thermal joining between the pair of sheets at the joined periphery. Additionally, the body may further include a bottom interposed between the pair of sheets at lower parts of the body, and spread out when the body is inflated by filling the internal space with gas, thus allowing the inflated body to stand.

According to another embodiments of the present invention, the valve assembly may include a pair of valve sheets, a first sheet of which has a convexly protruding line, and a second sheet of which has a concavely protruding line. The protruding lines correspond to each other and form a fastener by inserting closely the convexly protruding line into the concavely protruding line. The fastener may be formed at one place or at least two places between the pair of the valve sheets.

The valve assembly may further include a pair of binders securing together confronting side edges of the pair of the valve sheets, and a passage defined between the pair of the binders and between the pair of the valve sheets and extending from one opening of the valve assembly to the other opening. Also, the valve assembly may further include a non-adhesive coating formed in the passage to prevent the pair of valve sheets from adhering to each other when outer surfaces of the valve sheets are attached to the body. The non-adhesive coating may be directly formed on inner surfaces of the valve sheets or on a separate sheet interposed between the pair of the valve sheets.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 13:
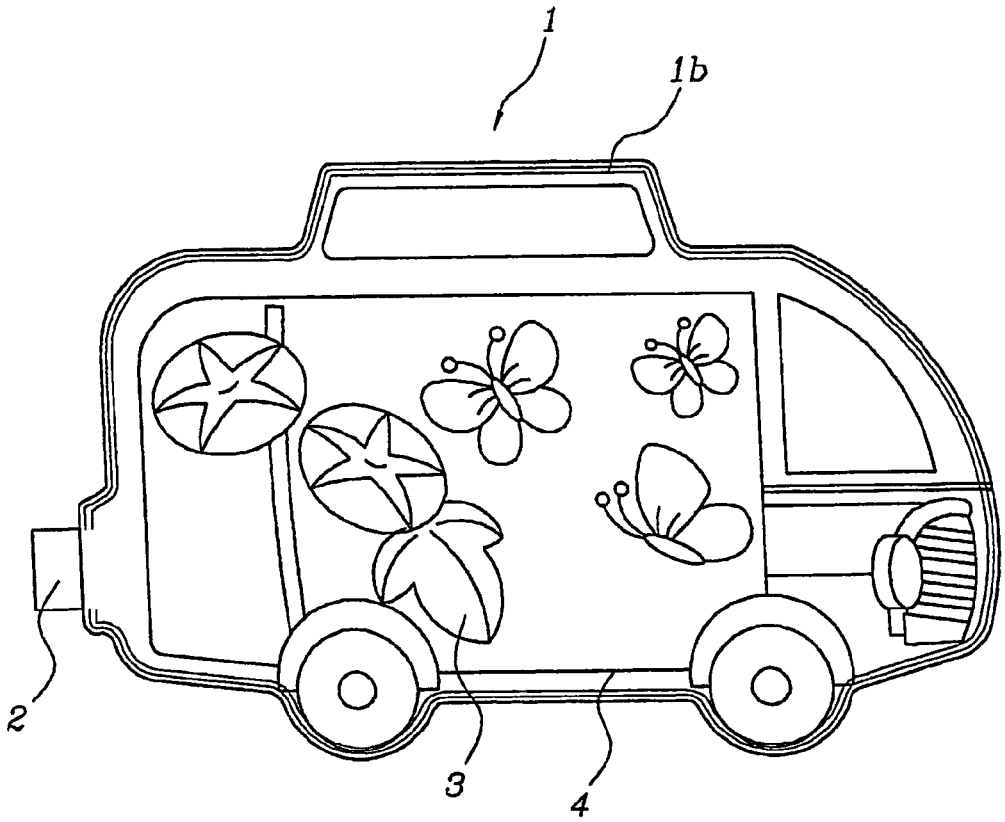
FIG. 13 is a front view showing a sheet type balloon in accordance with yet another embodiment of the present invention.

A sheet type balloon according to a preferred embodiment is shown in FIGS. 1 through 4. Referring to FIGS. 1 through 4, a body 1 of the balloon has an internal space 1*a* defined by a joined periphery 1*b*. A valve assembly 2 is formed at a specific place of the joined periphery 1*b* so as to allow an inflation gas to be introduced into the internal space 1*a*. After inflated, the body 1 has a desired, particular shape, for example, a turtle shown in FIG. 1, a bus shown in FIG. 13, or other various things.

Partly formed on an outer surface of the body 1 is a blank, colorable area 3 available for coloring with crayons or paints. Also, formed around the colorable area 3 is a printed area 4. The colorable area 3 is made of colorable material, such as paper, and attached onto or directly coated on the outer surface of the body 1. The printed area 4 is a design.

Figure 1:
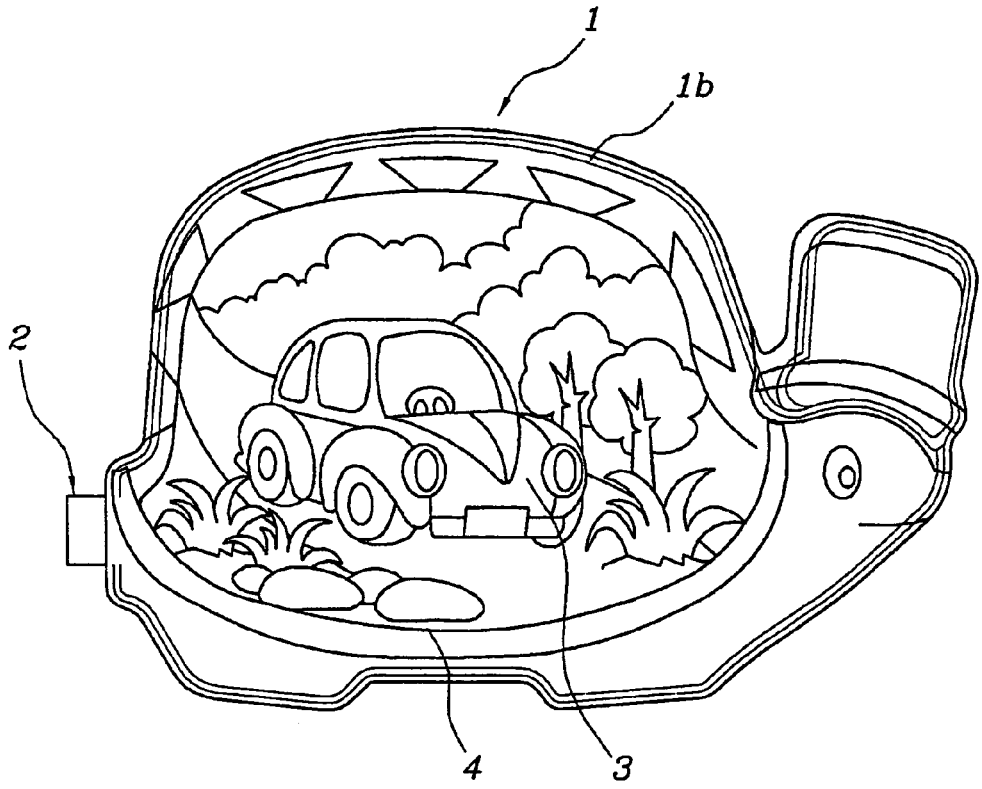
FIG. 1 is a front view showing a sheet type balloon in accordance with one embodiment of the present invention.
Figure 2:
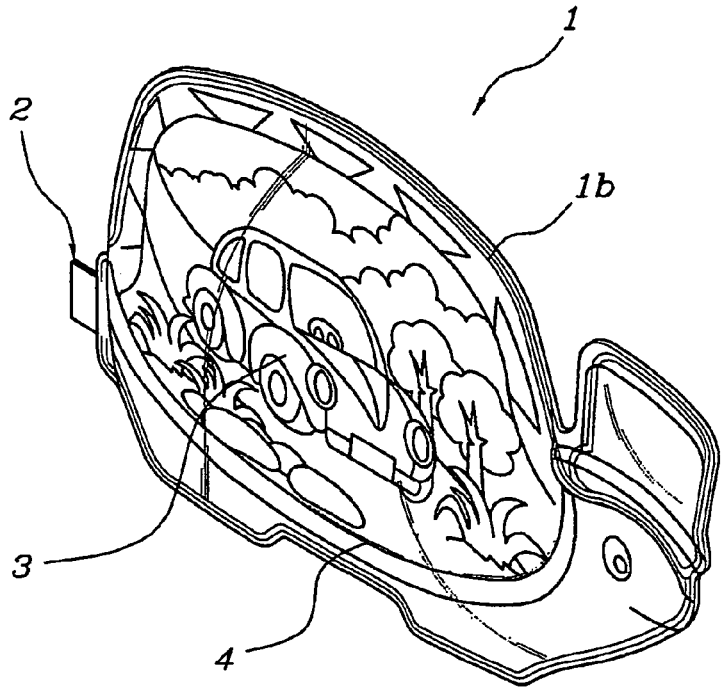
FIG. 2 is a perspective view of the sheet type balloon shown in FIG. 1 in an inflated state.
Figure 3:
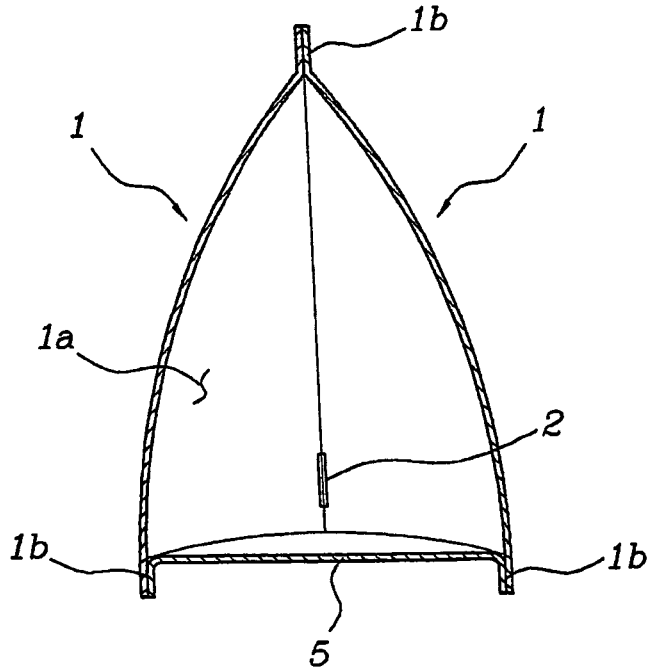
FIG. 3 is a cross-sectional view of the sheet type balloon shown in FIG. 2.
Figure 4:
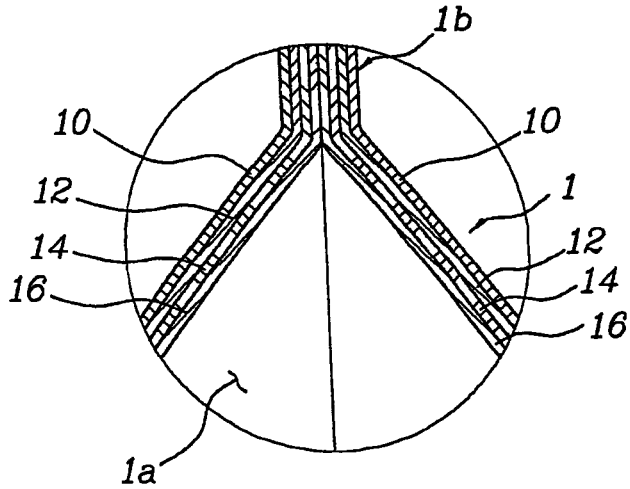
FIG. 4 is a partial, enlarged view of the sheet type balloon shown in FIG. 3.

As shown in FIGS. 3 and 4, the body 1 is composed of a pair of sheets thermally joined together at the periphery 1*b*. As best shown in FIG. 4, each sheet of the body 1 includes a paper layer 10, a first outer polyethylene layer 12, a nylon layer 14, and a second inner polyethylene layer 16. The paper layer 10 allows to be colored, and the nylon layer 14 improves durability of the sheet. The first outer polyethylene layer 12 intervenes between and firmly connects the paper layer 10 and the nylon layer 14. The second inner polyethylene layer 16 facilitates thermal joining between the pair of sheets at the periphery 1*b*.

Interposed between the pair of sheets at lower parts of the body 1 is a bottom 5 shown in FIG. 3. The bottom 5 is spread out when the body 1 is inflated by filling the internal space la with gas, thus allowing the inflated body 1 to stand.

Even though any conventional valves can be used, the sheet type balloon of the present invention uses a new, unique, bi-directional valve assembly 2, several examples of which are shown in FIGS. 5 through 12.

Figure 8:
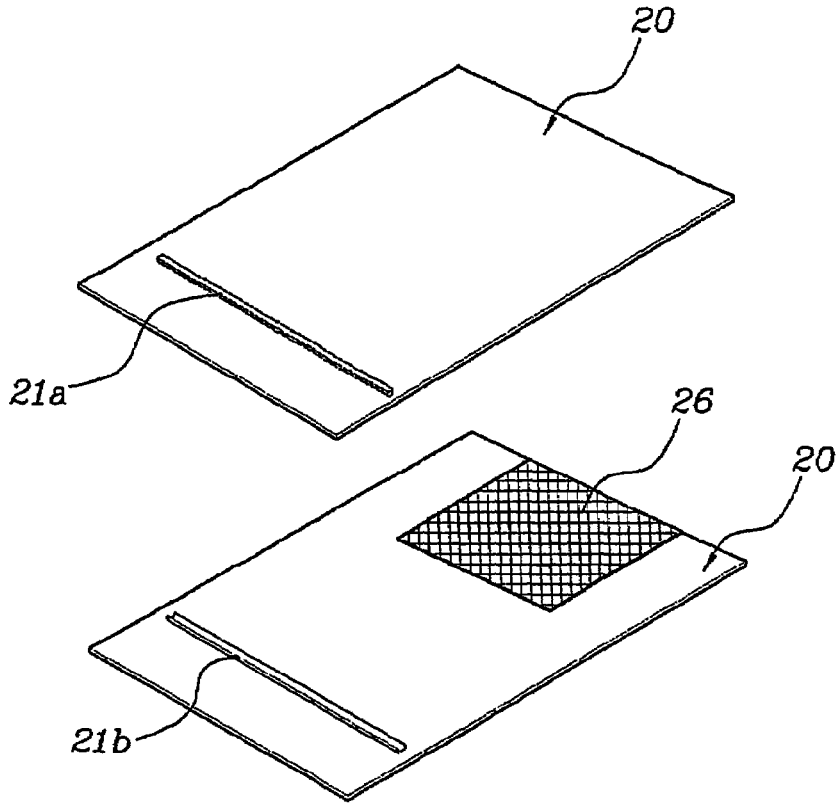
FIG. 8 is an exploded perspective view of a valve assembly of a sheet type balloon in accordance with still another embodiment of the present invention.
Figure 9:
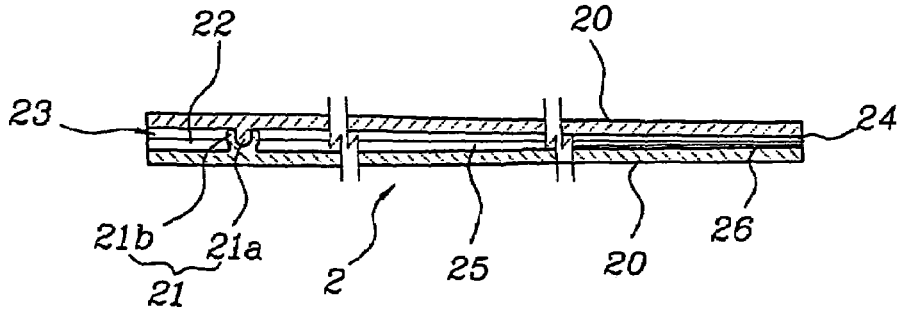
FIG. 9 is a cross-sectional view of the valve assembly shown in FIG. 8 after assembled.
Figure 10:
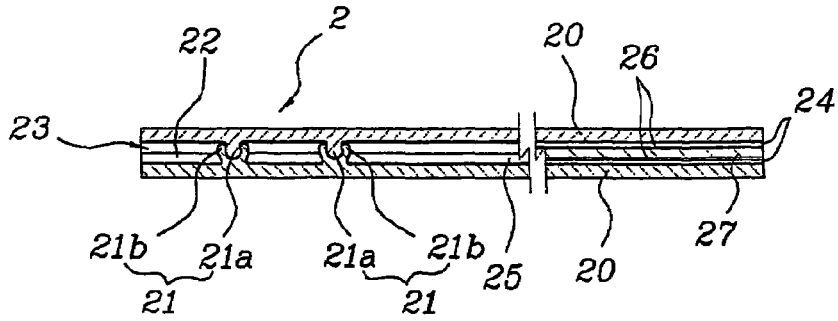
FIG. 10 is a cross-sectional view of a valve assembly of a sheet type balloon in accordance with yet another embodiment of the present invention.

The bi-directional valve assembly 2 is composed of a pair of valve sheets 20. One valve sheet 20 has a convexly protruding line 21*a*, and the other valve sheet 20 has a concavely protruding line 21*b*. Both protruding lines 21*a* and 21*b* correspond to each other and form a fastener 21 by inserting closely the convexly protruding line 21*a* into the concavely protruding line 21*b*. The fastener 21 can be formed at one place as shown in FIGS. 5 through 9, or alternatively at two or more places as shown in FIG. 10 so as to increase sealing effects.

Confronting side edges of the sheets 20, at which both ends of the protruding line 21*a* and 21*b* terminate, are secured together by a pair of binders 22. Therefore, excepting the fastener 21, a passage 25 is defined between the right and left binders 22 and between the upper and lower sheets 20, extending from one opening 23 to the other opening 24.

Figure 5:
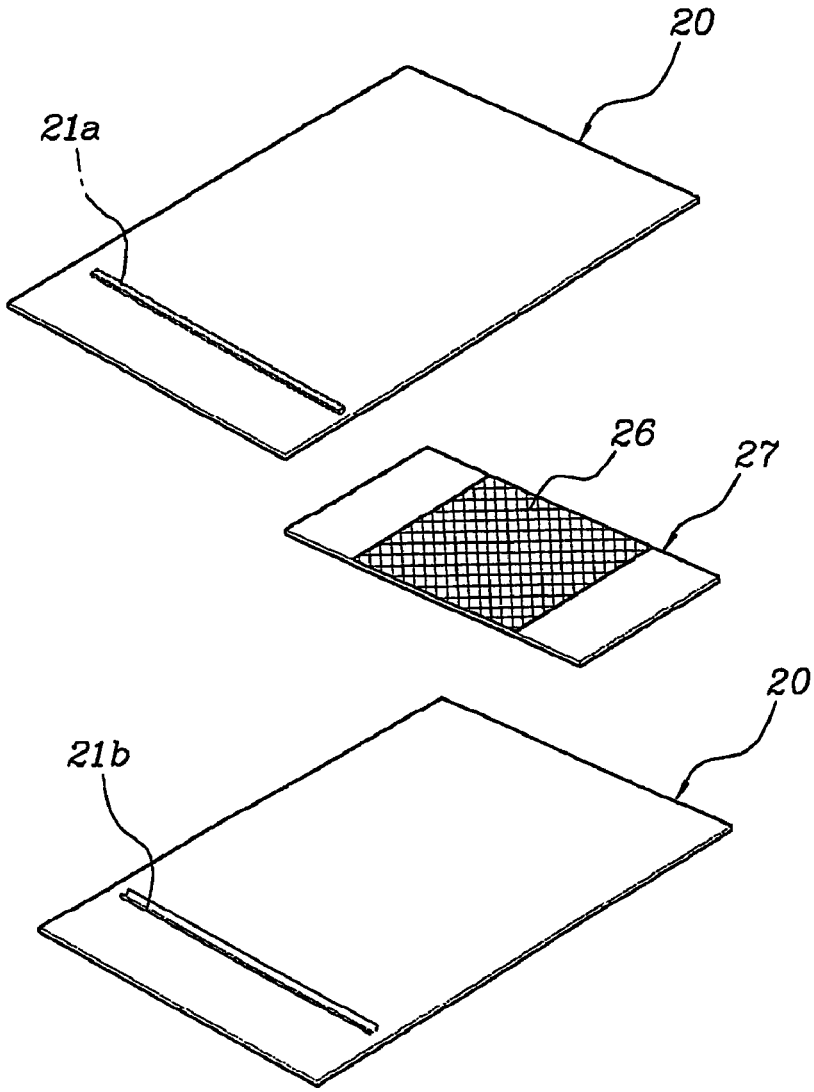
FIG. 5 is an exploded perspective view of a valve assembly of a sheet type balloon in accordance with another embodiment of the present invention.
Figure 6:
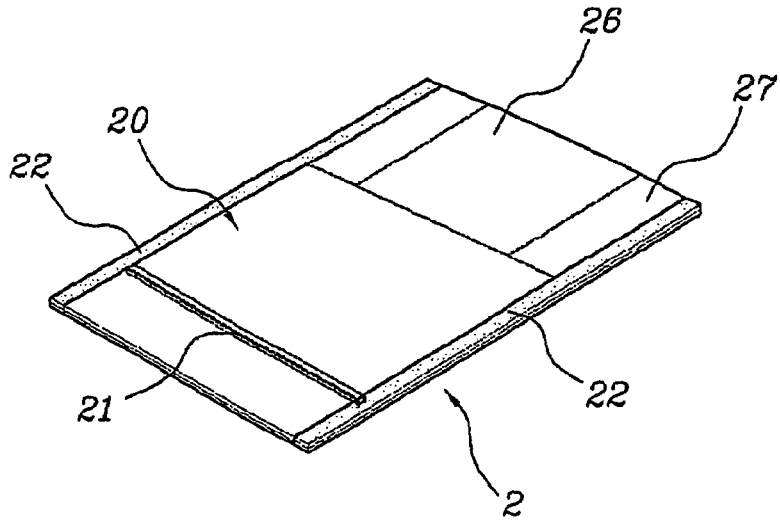
FIG. 6 is a perspective view of the valve assembly shown in FIG. 5 after assembled.
Figure 7:
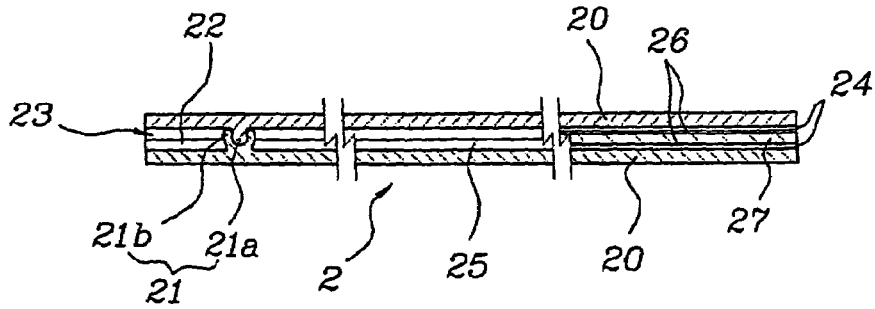
FIG. 7 is a cross-sectional view of the valve assembly shown in FIG. 6.

In the passage 25, a non-adhesive coating 26 is formed to prevent the pair of sheets 20 from adhering to each other when outer surfaces of the sheets 20 are attached to the body 1. The non-adhesive coating 26 can be directly formed on inner surfaces of the sheets 20 as shown in FIGS. 5 through 7, or alternatively on a separate sheet 27 interposed between the upper and lower sheets 20 as shown in FIGS. 8 and 9. Preferably, the non-adhesive coating 26 is printed with ink, not affinity for the sheets 20, in a photogravure manner.

Figure 11:
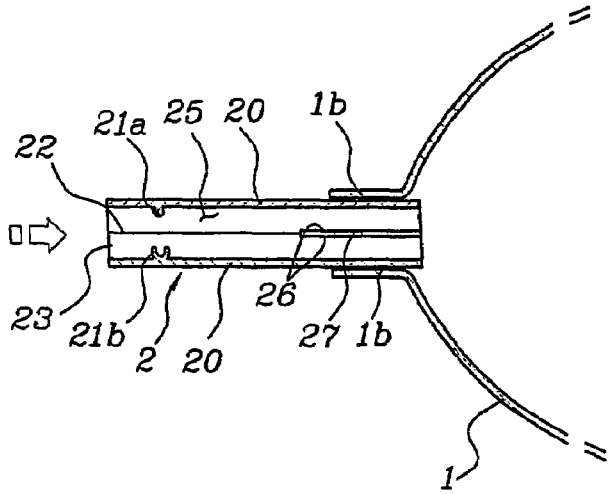
FIG. 11 is a partial, cross-sectional view of a valve assembly secured with a sheet type balloon in an open state in accordance with yet another embodiment of the present invention.
Figure 12:
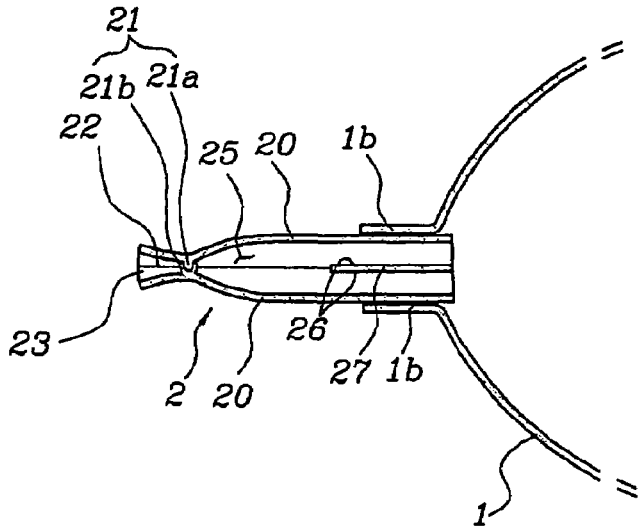
FIG. 12 is a partial, cross-sectional view of a valve assembly secured with a sheet type balloon in a closed state in accordance with yet another embodiment of the present invention.

For the fabrication of the sheet type balloon, as best shown in FIGS. 11 and 12, the valve assembly 2 is partially inserted into the body 1 such that one end adjacent to the non-adhesive coating 26 faces the body 1. Then, by thermally joining the outer surfaces of the valve sheets 20 to the joined periphery 1*b* of the body 1, the valve assembly 2 is fixed to the body 1. Here, an interface between the valve assembly 2 and the body 1 is sealed hermetically, whereas the passage 25 is established in the valve assembly 2 by the non-adhesive coating 26.

In a deflated state, the balloon of the present invention can be used as coloring or studying materials by painting the colorable area 3 with crayons or paints. In an inflated state, the balloon forms a desired three-dimensional shape attracting the interest as playing materials. Also, the inflated balloon can be stood though the bottom 5 spread out.

To inflate the balloon with air or gas, the fastener 21 of the valve assembly 2 becomes open by separating the convexly protruding line 21*a* and the concavely protruding line 21*b*, as shown in FIG. 11. Therefore, inflating air or gas can easily flow into the body 1 via the first opening 24, a space between the separated protruding lines 21*a* and 21*b*, the passage 25, and the second opening adjacent to the non-adhesive coating 26.

After inflation, the fastener 21 of the valve assembly 2 becomes closed by apply a pressure to both protruding lines 21*a* and 21*b*. Therefore, the protruding lines 21*a* and 21*b* are closely combined and thus intercept the outward flow of inflating air or gas within the body 1.

When a user wants to deflate the balloon for carrying, reuse or other purposes, a user has only to make the fastener 21 open by separating the protruding lines 21*a* and 21*b*. Accordingly, the valve assembly 2 of the present invention has bi-directional functions, that is, deflation and inflation of the balloon, on repeated occasions. Further, the valve assembly 2 of the present invention is available without additionally employing typical inflation probes.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A sheet type balloon comprising:

a body having an internal space defined by a joined periphery, and after inflated, having a particular shape;

a valve assembly formed at a specific place of the joined periphery so as to allow an inflation gas to be introduced into the internal space;

a blank, colorable area partly formed on an outer surface of the body, the colorable area being available for coloring with crayons or paints;

said blank, colorable area comprising a paper layer adhered to an exterior surface of said balloon body; and a printed area formed around the colorable area.

2. A sheet type balloon comprising:

a body having an internal space defined by a joined periphery, and after inflated, having a particular shape;

a valve assembly formed at a specific place of the joined periphery so as to allow an inflation gas to be introduced into the internal space;

a blank, colorable area partly formed on an outer surface of the body, the colorable area being available for coloring with crayons or paints;

the body includes a pair of sheets joined together at the joined periphery; and each sheet including a paper layer allowing to be colored, a nylon layer improving durability of the sheet, a first outer polyethylene layer intervening between and firmly connecting the paper layer and the nylon layer, and a second inner polyethylene layer facilitating thermal joining between the pair of sheets at the joined periphery.

3. A sheet type balloon comprising:

a body having an internal space defined by a joined periphery, and after inflated, having a particular shape;

a valve assembly formed at a specific place of the joined periphery so as to allow an inflation gas to be introduced into the internal space;

a blank, colorable area partly formed on an outer surface of the body, the colorable area being available for coloring with crayons or paints;

the body further including a bottom interposed between the pair of sheets at lower parts of the body, the bottom being spread out when the body is inflated by filling the internal space with gas, thus allowing the inflated body to stand; and said blank, colorable area comprising a paper layer adhered to an exterior surface of said balloon body.

4. A sheet type balloon comprising:

a body having an internal space defined by a joined periphery, and after inflated, having a particular shape;

a valve assembly formed at a specific place of the joined periphery so as to allow an inflation gas to be introduced into the internal space;

a blank, colorable area partly formed on an outer surface of the body, the colorable area being available for coloring with crayons or paints; and the valve assembly including a pair of valve sheets, a first sheet of which has a convexly protruding line, a second sheet of which has a concavely protruding line, the protruding lines corresponding to each other and forming a fastener by inserting closely the convexly protruding line into the concavely protruding line, a pair of binders securing together confronting side edges of the pair of the valve sheets, and a passage defined between the pair of the binders and between the pair of the valve sheets and extending from one opening of the valve assembly to the other opening.

5. The balloon of claim 4, wherein the valve assembly further includes a non-adhesive coating formed in the passage to prevent the pair of valve sheets from adhering to each other when outer surfaces of the valve sheets are attached to the body.

6. The balloon of claim 5, wherein the non-adhesive coating is directly formed on inner surfaces of the valve sheets.

7. The balloon of claim 5, wherein the non-adhesive coating is formed on a separate sheet interposed between the pair of the valve sheets.

* * * * *